US005590881A

United States Patent [19]

Jernigan

[11] Patent Number: 5,590,881

[45] Date of Patent: Jan. 7, 1997

[54] WEIGHTED GOLF IRON AND METHOD OF MAKING SAME

[76] Inventor: Doyle D. Jernigan, 3639 Rolling Forest, Spring, Tex. 77388

[21] Appl. No.: 282,970

[22] Filed: Jul. 29, 1994

[51] Int. Cl.[6] ..... A63B 53/04

[52] U.S. Cl. ..... 473/324; 273/DIG. 3; 473/350

[58] Field of Search ..... 273/169, 171, 273/172, 173, 167 F

[56] References Cited

U.S. PATENT DOCUMENTS 3,814,437 6/1974 Winquist ..... 273/169 X 4,355,808 10/1982 Jernigan et al. ..... 273/169

*Primary Examiner*—William H. Grieb

*Attorney, Agent, or Firm*—Sue Z. Shaper; Bulter & Binion

[57] ABSTRACT

An improved weighted golf iron and method of making same comprising adding a divider to a cavity in the iron, the divider dimensioned to be contained within and traverse the cavity walls, and providing means for anchoring the divider to the walls.

7 Claims, 1 Drawing Sheet

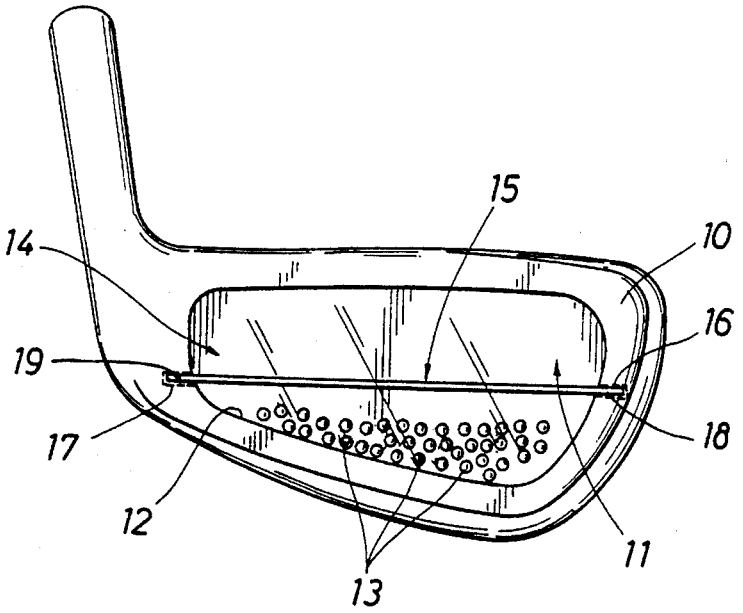
FIG. 1
FIG. 2
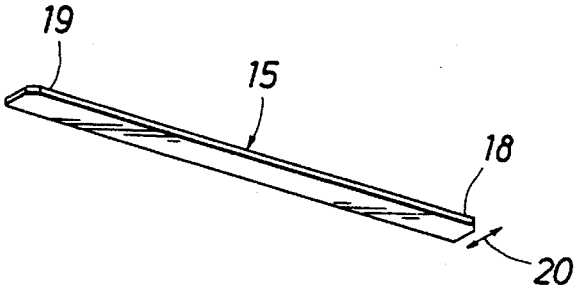
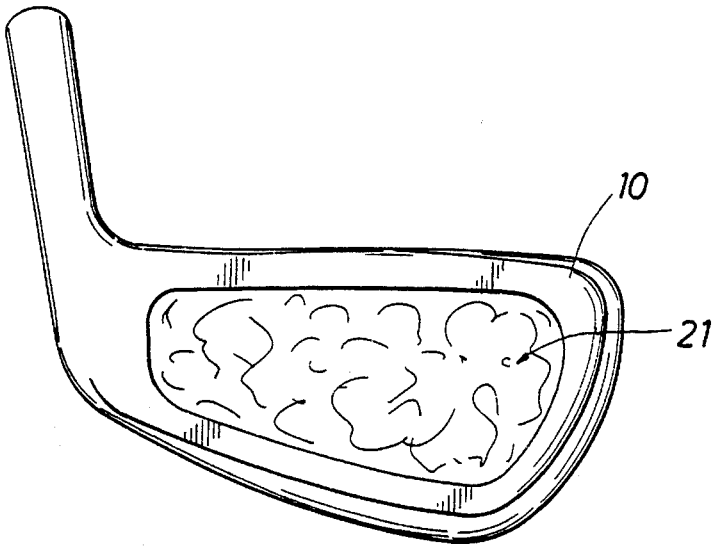
FIG. 3

WEIGHTED GOLF IRON AND METHOD OF MAKING SAME

FIELD OF THE INVENTION

This invention relates to an improved golf iron and method of making same, and more particularly, to an improved golf iron having a cavity filled with a plurality of weights and epoxy.

BACKGROUND OF THE INVENTION

Golf irons are normally made of cast steel. Frequently additional weights are inlaid to provide a sweet spot which improves the performance of the club.

Providing such a "sweet spot" has been known to include casting the iron head with a cavity that is filled with weights. Usually a plurality of small weights are used in order to weight each head carefully for the particular user.

Having determined the number and position of the weights, the cavity is filled with a material such as epoxy. It has been known to add a decorative epoxy layer to the cavity to add glamour to the club.

Golf clubs can be subjected to extremes of temperature. In particular, this may occur when the clubs are carried on an airplane. As a result of extreme temperature changes, upon occasion an epoxy filling may separate somewhat from the wall of a cavity. The present inventor has discovered that the addition of a divider, and more particularly, a metal bar dividing the cavity substantially into two parts and anchored inside the cavity to the cavity walls, significantly reduces any problem with the epoxy separating from the walls due to use, wear and the environment.

SUMMARY OF THE INVENTION

In a golf iron having a cavity filled with a plurality of weights and epoxy, an improvement is disclosed comprising a divider dimensioned to be contained within and to traverse the cavity from wall to wall, and including means for attaching the divider to the walls of the cavity.

In preferred embodiments the divider comprises a metal bar. Attaching means can comprise one or more slots in portions of the cavity wall, the slots dimensioned to receive an end of the bar. A 3/32 inch diameter metal bar has been determined to comprise an adequate bar.

In preparing the golf iron, the head is prepared with a cavity in the rear of the iron. The divider may then be attached within the cavity. In a preferred embodiment the divider is attached by slipping the ends of a metal bar into two opposing slots provided in wall portions of the cavity. The cavity is then filled by curing resin over weights added to the cavity.

BRIEF DESCRIPTION OF THE DRAWINGS

A better understanding of the present invention can be obtained from the detailed description of exemplary embodiment set forth below, to be considered in conjunction with the attached drawings, in which:

FIG. 1 provides a rear elevation view of a golf iron showing a cavity, a divider in weights.

FIG. 2 provides an elevation view of a divider.

FIG. 3 illustrates the golf iron of FIG. 1 filled with epoxy.

DESCRIPTION OF THE PREFERRED EMBODIMENTS

Applicant has previously invented a weighted inlaid golf iron and method of making same, described in U.S. Pat. No. 4,355,808. The disclosure of that patent is hereby incorporated by reference.

FIGS. 1 and 2 of the inventor's U.S. Pat. No. 4,355,808 patent show a golf iron prepared substantially according to the now existing art. A cavity is shown on the rear of the iron. The cavity is filled with small weights, preferably of a size similar to B—B's. A standard number 8 lead shot was determined to be adequate. In most cases between 219 grams and 229 grams of weight is added to the club.

FIG. 2 of U.S. Pat. No. 4,355,808 shows the iron having the cavity filled with epoxy, including a decorative outer layer.

FIG. 1 of the present invention shows a similar iron 10 having a similar cavity 11 with cavity wall 12, clear epoxy layer 14 and weights 13. Cavity wall 12 is shown with opposing slots 16 and 17, indicated by dashed lines. Opposing ends 18 and 19 of divider 15 are shown inserted into slots 16 and 17.

FIG. 2 shows divider bar 15 by itself. Divider bar 15 has a width or diameter 20 of approximately 3/32 of an inch.

FIG. 3 shows iron 10 having cavity 11 filled with clear epoxy 14 and decorative epoxy layer 21.

The function of divider 15 is to maintain the integration of epoxy filling cavity 11 and cavity walls 12. Divider 15 should be attached to and anchored to wall portions of cavity 11. Cavity wall slots 18 and 19 provide one convenient method of anchoring such divider. Those of skill in the art can easily devise functionally equivalent anchoring means. For instance, bar 15 could fit over projections from cavity walls 12.

In preparing the iron, divider 15 should be attached and anchored to the cavity walls prior to filling the cavity with epoxy, or at least prior to allowing an epoxy filled cavity to cure. As the preferred means for preparing the club, divider 15 would be anchored to the walls of the cavity prior to filling the cavity with weights. Then epoxy would be added to the cavity to cover and integrate with the weights and the divider.

The foregoing disclosure and description of the invention are illustrative and explanatory thereof. Various changes in the size, shape and materials, as well as in the details of the illustrated system, may be made without departing from the spirit of the invention.

What is claimed is:

1. In a golf iron having a cavity defined by walls, the cavity filled with a plurality of weights and epoxy, an improvement comprising a divider dimensioned to be contained within and traverse the cavity from wall to wall; and means for attaching the divider to wall portions of the cavity.

2. The apparatus of claim 1 wherein the divider comprises a metal bar.

3. The apparatus of claim 2 wherein the attaching means comprises slots in portions of the cavity walls, the slots dimensioned to receive an end of the bar.

4. The apparatus of claim 2 wherein the attaching means comprises opposing slots in portions of the cavity walls, each slot dimensioned to receive an end of the bar.

5. The apparatus of claim 2 wherein the bar comprises a 3/32 inch diameter rod.

6. In a method for preparing a golf iron including the steps of preparing a cavity in the iron, positioning a plurality of weights in the cavity and filling the cavity with epoxy, an improvement comprising anchoring a divider in the cavity substantially dividing the cavity into two parts prior to filling the cavity with epoxy.

7. The method of claim 6 wherein the divider comprises a metal bar and that includes providing opposing slots in wall portions of the cavity, each dimensioned to receive an end of the bar.

* * * * *